United States Patent [19]

Bizard

[11] Patent Number: 4,974,662

[45] Date of Patent: Dec. 4, 1990

[54] DEVICES FOR REMOVING WORN BALLS FROM CLEANING INSTALLATIONS FOR TUBE BUNDLES

[75] Inventor: André Bizard, Paris, France

[73] Assignee: Technos et Compagnie, France

[21] Appl. No.: 383,617

[22] Filed: Jul. 24, 1989

[30] Foreign Application Priority Data

Jul. 27, 1988 [FR] France ..... 88 10128

[51] Int. Cl.[5] ..... F28G 1/00

[52] U.S. Cl. ..... 165/95; 15/3.51; 15/104.062

[58] Field of Search ..... 209/250, 273, 675, 677, 209/678, 699, 906, 925, 940; 15/3.51, 104.062; 165/95

[56] References Cited

U.S. PATENT DOCUMENTS

| | | | |
|---|---|---|---|
| 3,174,171 | 3/1965 | McDermon | 15/104.062 |
| 3,251,466 | 5/1966 | Fleishman | 209/906 X |
| 3,785,487 | 1/1974 | Spencer | 209/906 X |
| 3,841,397 | 10/1974 | Eimer | 209/250 X |
| 4,314,604 | 2/1982 | Koller | 15/3.51 X |
| 4,420,038 | 12/1983 | Okouchi et al. | 15/3.51 X |
| 4,435,285 | 3/1984 | Okouchi et al. | 209/250 |

FOREIGN PATENT DOCUMENTS

| | | | |
|---|---|---|---|
| 57-19598 | 2/1982 | Japan | 165/95 |
| 58-184500 | 10/1983 | Japan | 165/95 |
| 0724875 | 3/1980 | U.S.S.R. | 15/104.062 |
| 1320643 | 6/1987 | U.S.S.R. | 165/95 |

*Primary Examiner*—Margaret A. Focarino
*Assistant Examiner*—Edward M. Wacyra
*Attorney, Agent, or Firm*—Larson and Taylor

[57] ABSTRACT

To remove worn elastic balls from a cleaning installation for a tube bundle, this installation comprising between the outlet and the inlet of the tube bundle, a recycling circuit for the balls, recourse is had to a static separator for worn balls joined to a pipe connected in bypass to the recycling pipe system and equipped with a collecting basket. The separator is joined directly between two sections of the recycling pipe system and the openings of separation of the worn balls are bounded by the crests of parallel rails extending in parallel with the liquid flow of the pipe system, the downstream ends of the rails being terminated by discontinuities adapted to detach automatically from the rails balls penetrating partially between these rails without being able to pass between them and drawn by sliding along the rails.

8 Claims, 1 Drawing Sheet

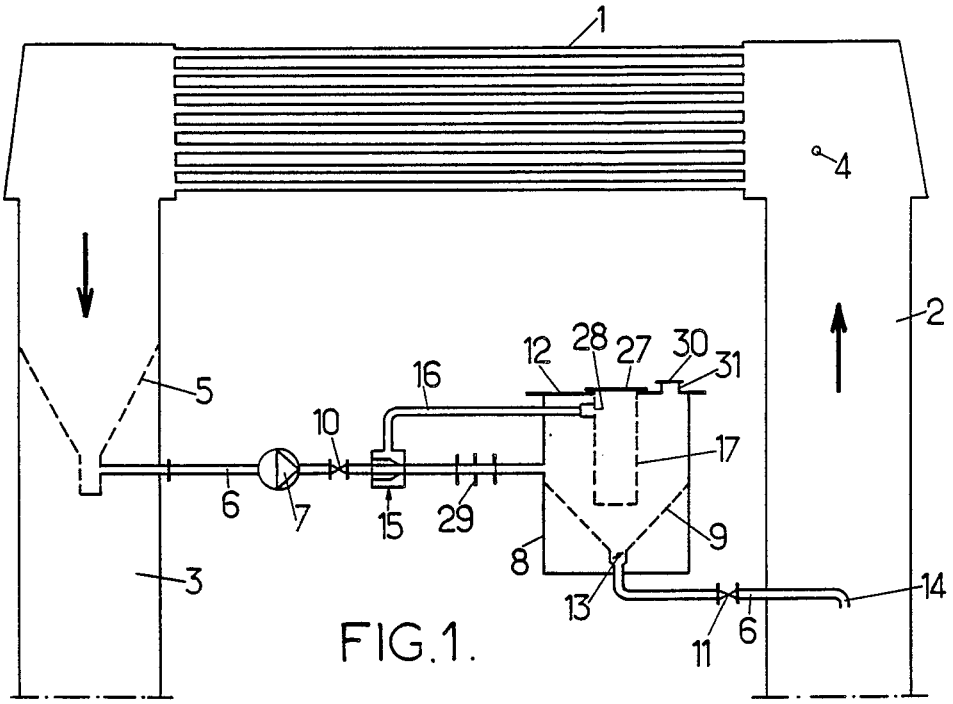
FIG.1.
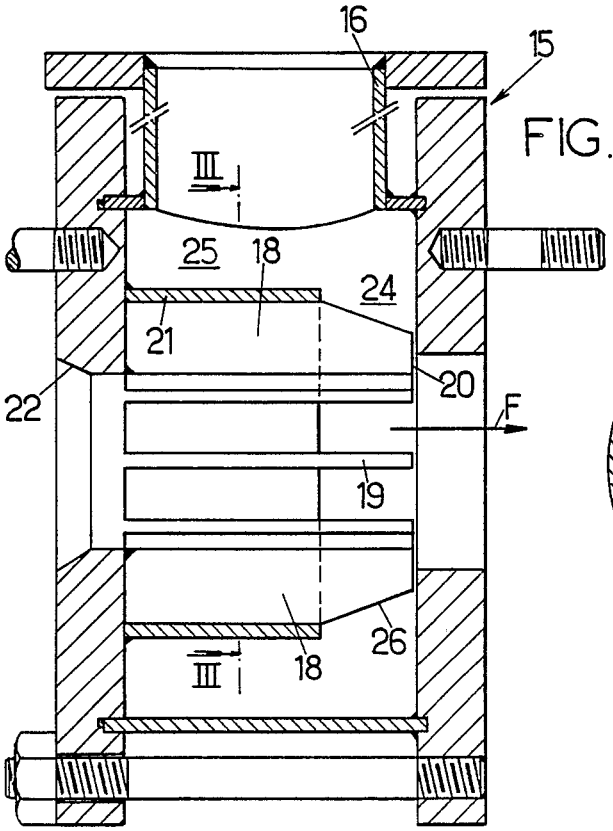
FIG.2.
FIG.3.
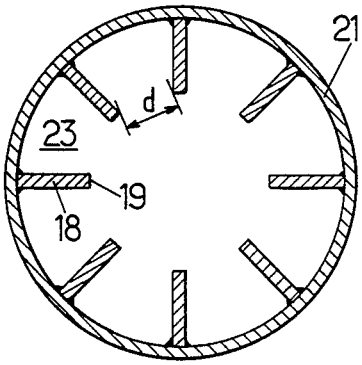

DEVICES FOR REMOVING WORN BALLS FROM CLEANING INSTALLATIONS FOR TUBE BUNDLES

BACKGROUND OF THE INVENTION

The invention relates to cleaning installations for tube bundles such as those equipping condensers of large steam turbines, heat exchangers of nuclear reactors . . . , such installations employing the forced flow in these tubes of balls of elastic material whose diameter is slightly greater than the diameter of the tubes, said flow being imposed by the liquid circulated through said tubes, and for example, being constituted by water drawn from a river.

It relates more particularily, among said installations, to those which comprise, between the outlet and the inlet of the tube bundle, a recycling system for balls comprising essentially a grid extending across the outlet pipe of said bundle so as to recover the balls emerging from this bundle, and a recycling pipe system or piping adapted to receive a flow of the abovesaid liquid charged with balls so recovered and to reinject this flow into the inlet pipe of the tube bundle, said pipe system passing successively through a drive pump and a ball collector, said collector being particularily constituted by a receptacle which can be isolated and opened.

To remove worn balls from said installations, that is to say balls whose diameter has become insufficient to ensure effective cleaning of the tubes, it has been proposed to include in these installations a separating or sorting chamber bounded by a screen, located inside the ball collector and joined to a point, of the recycling pipe system, situated downstream of this collector, the pipe which joins said chamber to said point passing through a basket for gathering and removing worn balls collected in the chamber.

The screen was then sheet metal perforated by circular openings having a diameter substantially equal to that of the worn balls to be removed and hence less than that of the sound balls.

Because of the elastic nature of the constituent material of the balls, those having a diameter slightly greater than that of the worn balls to be removed had a tendency to penetrate in part into the openings of the screen and to become jammed in these openings, with the risk of rapidly clogging the screen and of thus rendering it inoperative.

Attempts have been made to overcome this serious drawback by creating turbulence in the carrier liquid of the balls just upstream of the screen. However, in practice, the drawback indicated has not been really overcome.

It is a particular object of the invention to overcome this drawback.

GENERAL DESCRIPTION OF THE INVENTION

Accordingly, devices for removing worn balls according to the invention comprise also a static separating member for worn balls connected to a pipe which is joined as a bypass to the recycling pipe system and which is equipped with a collecting basket for the separated worn balls, and they are essentially characterized in that the separating member forms a section of the recycling pipe system and in that the separation openings for the worn balls comprised by this separating member are limited by the crests of parallel rails extending in parallel with the flow of liquid in said pipe system, the distance between these crests being slightly less than the diameter of the worn balls to be removed, and the downstream ends of said rails being terminated by discontinuities adapted to automatically detach from the rails the balls introduced partially between these rails without being able to pass between them and driven by sliding along said rails.

In preferred embodiments, recourse is had also to one/or other of the following features:

the constituent rails of the separating member are rectilinear, the crests of the rails according to the preceding paragraph form longitudinal bars of a cylindrical cage of revolution coaxial with the sections, of the recycling pipe system, between which said separating member is connected, the inner diameter of the cage according to the preceding paragraph is a little less than that of the sections of piping between which the separating member is connected, the inner diameter of the cage is equal to that of the sections of the pipe system between which the separating member is connected, the parallel rails are constituted by small plates of constant thickness extending radially in a ring from a cylindrical casing of revolution, towards the axis of this casing, the connection of the separating member to the recycling pipe system is effected upstream of the ball collector and the basket for gathering worn balls is joined at the downstream end of the bypass pipe and located inside the ball collector, a removable diaphragm is mounted on the bypass pipe, particularily at its downstream end.

The invention comprises, apart from these main features, certain other features which are preferably used at the same time and which will be more explicitly considered below.

In the following, a preferred embodiment of the invention will be described with reference to the accompanying drawing given of course purely as an nonlimiting example.

BRIEF DESCRIPTION OF THE DRAWINGS

FIG. 1, of these drawings, shows diagramatically a tube bundle and an installation designed to clean this bundle by means of balls of elastic material, this plant being equipped with a device according to the invention for the removal of worn balls.

FIGS. 2 and 3 show respectively in axial section and in partial cross section along the line III—III, FIG. 2, the separating member comprised by this removal device.

In manner known in itself, the tube bundle 1 to be cleaned is designed to be traversed by a liquid such as water from a river and this liquid is brought to said bundle through an inlet pipe 2 and removed from the bundle through a discharge pipe 3.

The cleaning of the tubes is effected by means of balls 4 of elastic material which are drawn by the liquid and which have originally a diameter slightly greater than the inner diameter of the tubes 1.

The discharge pipe 3 is equipped with a grid 5 designed to recover the balls 4 emerging from the tubes 1 and to recycle these balls by reinjecting them into the inlet pipe 2 through a recycling pipe system or piping 6.

This pipe system passes successively through a drive pump 7 and a ball collector 8.

This collector 8 contains a basket 9 permeable to liquid but which can retain the balls.

Two valves respectively upstream 10 and downstream 11 mounted in the pipe system 6 enable the collector 8 to be isolated from the rest of this pipe system.

The collector can then be opened by a cover 12 so as to permit the removal of the balls gathered in the basket 9.

At the base of this basket 9 is a valve 13 enabling either the retention in the latter of all of the balls which arrive at the collector 8, or to allow these balls to escape towards the downstream end 14 of the pipe system 6 so as to reinject them into the inlet pipe 2.

As explained previously, the invention proposes to separate automatically and to remove from the installation the balls which have become ineffective due to the fact of their wear, manifested by a reduction in the diameter.

In fact, this diameter must remain slightly greater than the internal diameter of the tubes 1 to be cleaned, failing which the balls pass through these tubes without scraping their inner surfaces.

For this purpose, there is mounted in the recycling pipe system 6 between the upstream valve 10 and the ball collector 8, a separating member 15 for worn balls, which member is itself joined by a pipe 16 to a basket for collection and removal 17 permeable to the liquid, but not traversable by the balls, and placed inside the collector 8.

The separator 15 is itself formed of static components which cannot be clogged by the balls, namely by rails 18 parallel with each other and parallel to the flow of the liquid circulating in the pipe system 6.

The separating meshes are bounded by the crests 19 of the parallel rails 18, which crests are separated mutually from one another by a distance d (FIG. 3) slightly less than the diameter of the worn balls to be removed: this distance d is for example equal to 18 mm if the diameter of the worn balls to be removed is comprised between 22 and 24 mm.

To prevent any clogging of said meshes by balls a little too large which penetrate partly between the rails without being able to pass between them, and which then slide along the crests 19 of these rails under the impulse of the liquid, there is provided at the downstream end of each rail 18 a radial discontinuity visible at 2O in FIG. 2.

The balls partly introduced between the rails, but too big to pass between the latter, slide along these rails and are automatically detached from the rails on arriving at the level of the discontinuities 2O, which are preferably joined to the crests 19 of the corresponding rails by a sharp angle, preferably a right angle.

The rails 18 are advantageously constituted by flat fins extending radially in a ring, from a cylindrical casing of revolution 21, towards the axis of this casing.

The crests 19 of these rails then extend along the longitudinal bars of a sort of cylindrical cage coaxial with the section of pipe system 6 in which it is connected.

As seen in FIG. 2, the inner diameter of this cage can be smaller than that of the two sections of piping 6 which extend it, said cage then being joined to the upstream section by a frustoconic area 22 and to the downstream section by the abovedescribed discontinuities 20.

According to another advantageous modification, said inner diameter of the cage is equal to that of the sections of pipe system 6 which extend this cage, the frustoconic inlet area 22 then being removed and replaced at the outlet from the separator, so as to guide to the downstream section of pipe system 6 the contents of the ring, of enlarged diameter, which is axially contiguous with the downstream terminal sections of the rails 18.

The structure proposed above for the rails 18 has the advantage of offering a widened space 23 (FIG. 3) to each worn ball as soon as the latter has passed through the mesh defined by two contiguous crests 19: in this way, these balls are immediately evacuated to the pipe 16 as soon as they have passed through the mesh concerned.

The connection between the meshes and the pipe 16 is effected through successively:

an annular opening 24 provided at the downstream axial end of the casing 21, around the downstream ends of the rails 18, the direction "downstream" being defined with respect with the direction of flow of the liquid denoted by the arrow F, an annular chamber 25 surrounding the casing 21 and the opening 24.

To improve the circumferential flow of the balls in the spaces 24 and 25, the former is enlarged by cutting off as a bèvel at 26 the outer downstream ends of the constituent fins of the rails 18.

The basket 17 is equipped with a cover 27 itself mounted removably on the cover 12 of the collector 8, which permits said basket 17 to be replaced and its contents to be removed without it being necessary to open the cover 12, but of course after closing the two valves 10 and 11.

On the downstream end of the pipe 16, which end is joined to the basket 17, is advantageously mounted a removable diaphragm 28.

The choice of this diaphragm enables the relative suction which exists in the pipe 16 to be regulated as desired and hence the hydraulic aspirating force exerted from this pipe 16 on the liquid and the balls passing through the separator 15.

This regulation enables the maximum value of the diameter of the worn elastic balls which are sorted out by the separator 15, to be very easily modified.

Thus, by simple change of the diaphragm 28, this maximum value may be regulated between 22 and 24 mm for a given elasticity of the balls, if the opening d of the separation meshes has the value of 18 mm indicated above.

Of course, everything being otherwise equal, said maximum value would be less than those of the above numerical example if the elasticity of the balls was less than that taken for this example and vice versa.

There is to be seen also in FIG. 1:

a ball counting device 29 mounted in the pipe system 6, between the separator 15 and the collector 8, and a plug 30 removably closing a tubular end piece 31 provided on the cover 12 and permitting the installation to be recharged with fresh balls.

The operation of the separating device for worn balls described above is as follows.

When the cleaning installation for the tubes 1 is in normal service, with recycling of the balls 4, all these balls enter the separator 15 during each cycle.

All those, of these balls, which are still effective for the cleaning, that is to say which have a diameter distinctly greater than the length d, pass axially through the separator 15 from one side to the other.

Certain of those of said balls, of which the diameter is reduced, but which can still serve for cleaning, can penetrate partially between two contiguous rails, but they slide then along these rails due to the fact of the drive of the liquid and they are released into the recycling circuit on arriving at the downstream ends of these rails, due to the discontinuities 20.

Certain of the balls considered as worn, that is to say whose diameter is less than or equal to the length d or only slightly greater than this length d, pass through the meshes defined by the crests 19 of the rails 18, at the cost possibly of slight elastic compression, and are immediately routed through the pipe 16 to the basket 17.

This is not the case of all the worn balls on their first passage in the separator, for a certain number of the latter may then be spaced from the crests 19, or even at the center of the liquid flow in circulation.

However it must be observed that, during the life of each ball, the number of its passages into the separator is very high.

Thus generally these passages are repeated twice per minute whilst the normal duration of efficacity of a ball generally exceeds a week.

If therefore a worn ball is not removed on its first passage consecutive to the moment when its wear has become sufficient to justify removal, the probability that it will be removed shortly afterwards, that is to say in the course of several subsequent passages, is very great, and as the device operates constantly the efficiency of the automatic separation that it ensures is excellent.

When the basket is sufficiently filled with worn balls, which can be determined automatically, particularily by counting balls remaining in the installation by means of the member 29, this basket can be disengaged through the cover 27 after temporarily closing the two valves 10 and 11.

A further charge of fresh balls is then introduced through the end piece 31 after disengagement of the plug 30, in order to compensate for the balls removed.

To determine automatically the degree of filling of basket 17 with worn balls, there could be mounted directly on the pipe 16 a ball counter.

As a result of which, and whatever the embodiment adopted, there is finally obtained a removal device for worn balls for a cleaning installation for tube bundles whose constitution and operation result sufficiently from the foregoing.

This device has numerous advantages with respect to those previously known and in particular the following:

it permits the removal from the installation of only worn balls, its exploitation is extremely simple since separation of the worn balls is automatic and it suffices to empty the basket 17 periodically when it is filled with worn balls and to reintroduce into the collector 8 an identical number of new balls, the separator comprised by this device is extremely robust since it does not comprise any movable part and it is very effective since it cannot be clogged by balls whose diameter is slightly greater than the worn ones which it is designed to remove.

As is self-evident, and as emerges besides already from the foregoing, the invention is in no way limited to those types of application and embodiments which have been more especially envisaged; it encompasses, on the contrary, all modifications.

I claim:

1. Device for removing worn elastic balls from a cleaning installation for a tube bundle traversed by a liquid, said installation comprising, between the outlet and the inlet of the tube bundle, a recycling circuit for balls comprising essentially a grid extending across the outlet pipe of said bundle so as to recover the balls emerging from this bundle, and a recycling pipe system adapted to receive a flow of the above liquid charged with balls thus recovered and to reinject this flow into the inlet pipe of the tube bundle, said pipe system traversing successively a drive pump and a ball collector, said device comprising a static separator member for worn balls connected to a pipe which is connected in bypass on the recycling pipe system and which is equipped with a basket for collecting the separated worn balls, wherein the separating member forms a section of the recycling pipe system and wherein the separating openings for the worn balls comprised by this separating member are bounded by the crests of parallel rails extending in parallel with the liquid flow in said pipe system, the distance between these crests being slightly less than the diameter of the worn balls to be removed, and the downstream ends of said rails being terminated by discontinuities adapted to detach automatically from the rails balls partially inserted between these rails without being able to pass between them and drawn by sliding along said rails.

2. Device according to claim 1, wherein the constituent rails of the separator member are rectilinear.

3. Device according to claim 2, wherein the crests of the constituent rails of the separator member form longitudinal bars of a cylindrical cage of revolution coaxial with the sections, of the recycling pipe system between which said separating member is connected.

4. Device according to claim 3, wherein the inner diameter of the cage is equal to that of the sections of pipe system between which the separator member is connected.

5. Device according to claim 2, wherein the internal diameter of the cage is a little less than that of the sections of pipe system between which the separating member is connected.

6. Device according to claim 1, wherein the parallel rails are constituted by small plates of constant thickness extending radially in a ring from a cylindrical casing of revolution, towards the axis of this casing.

7. Device according to claim 1, wherein the connection of the separating member to the recycling pipe system is effected upstream of the ball collector and wherein the basket for gathering the worn balls is joined at the downstream end of the bypass pipe and positioned inside the ball collector.

8. Device according to claim 1, wherein a removable diaphragm is mounted in the bypass pipe, particularly at its downstream end.

* * * * *